US008897907B2

(12) United States Patent
Ikeba

(10) Patent No.: US 8,897,907 B2
(45) Date of Patent: Nov. 25, 2014

(54) DATA GENERATING DEVICE, SEWING MACHINE AND NON-TRANSITORY COMPUTER-READABLE MEDIUM STORING CONTROL PROGRAM FOR DATA GENERATING DEVICE

(75) Inventor: Masae Ikeba, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 672 days.

(21) Appl. No.: 13/210,000

(22) Filed: Aug. 15, 2011

(65) Prior Publication Data

US 2012/0067263 A1 Mar. 22, 2012

(30) Foreign Application Priority Data

Sep. 16, 2010 (JP) ..... 2010-207862

(51) Int. Cl.
*D05C 5/02* (2006.01)
*D05B 19/10* (2006.01)
*D05B 19/12* (2006.01)

(52) U.S. Cl.
CPC ..... *D05B 19/10* (2013.01); *D05B 19/12* (2013.01)
USPC ..... 700/138; 112/470.04

(58) Field of Classification Search
CPC ..... D05B 19/00; D05B 19/02; D05B 19/08; D05B 19/085; D05B 19/10; D05B 19/12
USPC ..... 112/102.5, 470.01, 470.04; 700/136–138
See application file for complete search history.

(56) References Cited

U.S. PATENT DOCUMENTS

| | | | | |
|---|---|---|---|---|
| 4,607,585 | A * | 8/1986 | Meier | 112/454 |
| 5,319,565 | A | 6/1994 | Hausammann et al. | |
| 5,894,294 | A * | 4/1999 | Morita | 700/136 |
| 6,189,467 | B1 * | 2/2001 | Tomita | 112/102.5 |
| 7,299,757 | B2 | 11/2007 | Niizeki et al. | |
| 2006/0027153 | A1 | 2/2006 | Hirata et al. | |

FOREIGN PATENT DOCUMENTS

| | | |
|---|---|---|
| JP | A-03-295587 | 12/1991 |
| JP | A-05-161770 | 6/1993 |
| JP | A-2002-301281 | 10/2002 |
| JP | A-2003-326023 | 11/2003 |
| JP | A-2006-043231 | 2/2006 |
| JP | A-2006-346087 | 12/2006 |

* cited by examiner

*Primary Examiner* — Nathan Durham
(74) *Attorney, Agent, or Firm* — Oliff PLC

(57) ABSTRACT

A data generating device includes a selection portion that selects a plurality of patterns from among patterns that are to be sewn based on sewing data stored in a storage portion, an acquisition portion that acquires first sewing data that are sewing data for sewing the plurality of patterns selected by the selection portion, an arrangement setting portion that sets an arrangement of the plurality of patterns selected by the selection portion, a first sewing data generating portion that generates second sewing data based on the first sewing data that are acquired by the acquisition portion, and a first storage control portion that causes the second sewing data generated by the first sewing data generating portion to be stored in the storage portion such that it can be acquired by the acquisition portion.

15 Claims, 24 Drawing Sheets

FIG. 5

170

| DATA NUMBER (n) | FEED AMOUNT ($F_n$) | NEEDLE SWING AMOUNT ($Z_n$) |
|---|---|---|
| 1 | 0 | 4 |
| 2 | 5 | 4 |
| 3 | -2 | 2 |
| 4 | 0 | 6 |
| 5 | 2 | 4 |

FIG. 11

171

| DATA NUMBER (n) | FEED AMOUNT ($F_n$) | NEEDLE SWING AMOUNT ($Z_n$) |
|---|---|---|
| 1 | 0 | 2 |
| 2 | 0 | 6 |
| 3 | 4 | 6 |
| 4 | 0 | 2 |
| 5 | -2 | 2 |
| 6 | 0 | 4 |
| 7 | 4 | 4 |
| 8 | 0 | 2 |
| 9 | 2 | 2 |

FIG. 17

| 172 | | | | 173 | |
|---|---|---|---|---|---|
| DATA NUMBER (n) | FEED AMOUNT ($F_n$) | NEEDLE SWING AMOUNT ($Z_n$) | POINT | $X_n$ | $Y_n$ |
| 1 | 0 | 4 | P1 | 4 | 0 |
| 2 | 5 | 4 | P2 | 4 | 5 |
| 3 | −2 | 2 | P3 | 2 | 3 |
| 4 | 0 | 6 | P4 | 6 | 3 |
| 5 | 2 | 2 | P5' (Q1) | 2 | 5 |
| 6 | 0 | 6 | Q2 | 6 | 5 |
| 7 | 4 | 6 | Q3 | 6 | 9 |
| 8 | 0 | 2 | Q4 | 2 | 9 |
| 9 | −2 | 2 | Q5 | 2 | 7 |
| 10 | 0 | 4 | Q6 | 4 | 7 |
| 11 | 4 | 4 | Q7 | 4 | 11 |
| 12 | 0 | 2 | Q8 | 2 | 11 |
| 13 | 2 | 4 | Q9 | 4 | 13 |

FIG. 20

174 175

| DATA NUMBER (n) | FEED AMOUNT ($F_n$) | NEEDLE SWING AMOUNT ($Z_n$) | POINT | $X_n$ | $Y_n$ |
|---|---|---|---|---|---|
| 1 | 0 | 4 | P1 | 4 | 0 |
| 2 | 5 | 4 | P2 | 4 | 5 |
| 3 | -2 | 2 | P3 | 2 | 3 |
| 4 | 0 | 6 | P4 | 6 | 3 |
| 5 | 2 | 4 | P5 (Q1') | 4 | 5 |
| 6 | 0 | 6 | Q2 | 6 | 5 |
| 7 | 4 | 6 | Q3 | 6 | 9 |
| 8 | 0 | 2 | Q4 | 2 | 9 |
| 9 | -2 | 2 | Q5 | 2 | 7 |
| 10 | 0 | 4 | Q6 | 4 | 7 |
| 11 | 4 | 4 | Q7 | 4 | 11 |
| 12 | 0 | 2 | Q8 | 2 | 11 |
| 13 | 2 | 2 | Q9 | 2 | 13 |
| 14 | 0 | 4 | Q10 | 4 | 13 |

DATA GENERATING DEVICE, SEWING MACHINE AND NON-TRANSITORY COMPUTER-READABLE MEDIUM STORING CONTROL PROGRAM FOR DATA GENERATING DEVICE

CROSS-REFERENCE TO RELATED APPLICATION

This application claims priority to Japanese Patent Application No. 2010-207862, filed Sep. 16, 2010, the content of which is hereby incorporated herein by reference.

BACKGROUND

The present disclosure relates to a data generating device that generates sewing data that are data indicating a movement amount of a sewing object by a feed dog and a swing position of a needle bar by a needle bar swing mechanism, a sewing machine and a non-transitory computer-readable medium that stores a control program for the data generating device.

In known art, a pattern data generating device is known that generates, in accordance with an instruction by a user, sewing data for sewing a pattern, the sewing data indicating a movement amount of a sewing object fed by a feed dog and a swing position of a needle bar swung by a needle bar swing mechanism. This type of pattern data generating device generates the sewing data for a sewing machine that includes a feed mechanism having the feed dog and the needle bar swing mechanism. The feed dog moves the sewing object in a first predetermined direction. The needle bar swing mechanism swings the needle bar in a second predetermined direction that intersects with the first predetermined direction.

SUMMARY

In the known pattern data generating device, even if sewing data for sewing a new pattern are generated in accordance with an instruction that is input using a touch panel, it may not be possible to use the generated sewing data as the user intends.

Various embodiments of the broad principles derived herein provide a data generating device, a sewing machine and a non-transitory computer-readable medium that stores a control program for the data generating device that improve usability for a user when generating sewing data that indicate a movement amount of a sewing object by a feed dog and a swing position of a needle bar by a needle bar swing mechanism.

Embodiments provide a data generating device that includes a selection portion that selects a plurality of patterns from among patterns that are to be sewn based on sewing data stored in a storage portion. The sewing data is data that indicate a movement amount of a sewing object fed by a feed dog in a first predetermined direction and a swing position of a needle bar swung by a needle bar swing mechanism in a second predetermined direction. The feed dog, the needle bar swing mechanism and the needle bar are provided in a sewing machine. The second predetermined direction is a direction that intersects with the first predetermined direction. The data generating device also includes an acquisition portion that acquires first sewing data that are sewing data for sewing the plurality of patterns selected by the selection portion from among the sewing data stored in the storage portion. The data generating device further includes an arrangement setting portion that sets an arrangement of the plurality of patterns selected by the selection portion. The data generating device further includes a first sewing data generating portion that generates second sewing data based on the first sewing data that are acquired by the acquisition portion. The second sewing data is sewing data for sewing a combined pattern that is a pattern that combined the plurality of patterns selected by the selection portion in accordance with the arrangement set by the arrangement setting portion. The data generating device further includes a first storage control portion that causes the second sewing data generated by the first sewing data generating portion to be stored in the storage portion such that it can be acquired by the acquisition portion.

Embodiments also provide a sewing machine that includes a needle bar that has a sewing needle fitted at a bottom end and a feed mechanism that drives a feed dog that moves a sewing object in a first predetermined direction. The sewing machine also includes a needle bar swing mechanism that swings the needle bar in a second predetermined direction. The second predetermined direction is a direction that intersects with the first predetermined direction. The sewing machine further includes a selection portion that selects a plurality of patterns from among patterns that are to be sewn based on sewing data stored in a storage portion. The sewing data is data that indicate a movement amount of the sewing object fed by the feed dog in the first predetermined direction and a swing position of the needle bar swung by the needle bar swing mechanism in the second predetermined direction. The sewing machine further includes an acquisition portion that acquires first sewing data that are sewing data for sewing the plurality of patterns selected by the selection portion from among the sewing data stored in the storage portion. The sewing machine further includes an arrangement setting portion that sets an arrangement of the plurality of patterns selected by the selection portion. The sewing machine further includes a first sewing data generating portion that generates second sewing data based on the first sewing data that are acquired by the acquisition portion. The second sewing data is sewing data for sewing a combined pattern that is a pattern that combined the plurality of patterns selected by the selection portion in accordance with the arrangement set by the arrangement setting portion. The, sewing machine further includes a first storage control portion that causes the second sewing data generated by the first sewing data generating portion to be stored in the storage portion such that it can be acquired by the acquisition portion and a sewing portion that sews the combined pattern on the sewing object based on the second sewing data by controlling the feed mechanism and the needle bar swing mechanism.

Embodiments further provide a non-transitory computer-readable medium storing a control program executable on a data generating device. The program includes instructions that cause a computer of the data generating device to perform the steps of accepting, from among patterns that are to be sewn based on sewing data stored in a storage portion, a selection of a plurality of patterns, the sewing data is data that indicate a movement amount of a sewing object fed by a feed dog in a first predetermined direction and a swing position of a needle bar swung by a needle bar swing mechanism in a second predetermined direction, the feed dog, the needle bar swing mechanism and the needle bar are provided in a sewing machine, and the second predetermined direction is a direction that intersects with the first predetermined direction, acquiring first sewing data that are sewing data for sewing the plurality of patterns selected from among the sewing data stored in the storage portion, setting an arrangement of the selected plurality of patterns, generating second sewing data based on the acquired first sewing data, the second sewing data is sewing data for sewing a combined pattern that is a pattern that combined the selected plurality of patterns in accordance with the set arrangement, and causing the generated second sewing data to be stored in the storage portion in an acquirable manner.

BRIEF DESCRIPTION OF THE DRAWINGS

Embodiments will be described below in detail with reference to the accompanying drawings in which:

FIG. 5 is an explanatory diagram of sewing data for sewing the pattern shown in FIG. 4;

FIG. 11 is an explanatory diagram of sewing data for sewing the pattern shown in FIG. 10;

FIG. 17 is an explanatory diagram of sewing data for sewing the combined pattern and vector data of the combined pattern;

FIG. 20 is an explanatory diagram of sewing data for sewing the combined pattern and vector data of the combined pattern;

DETAILED DESCRIPTION

A sewing machine 1 according to first and second embodiments will be described in order with reference to the drawings.

Figure 1:
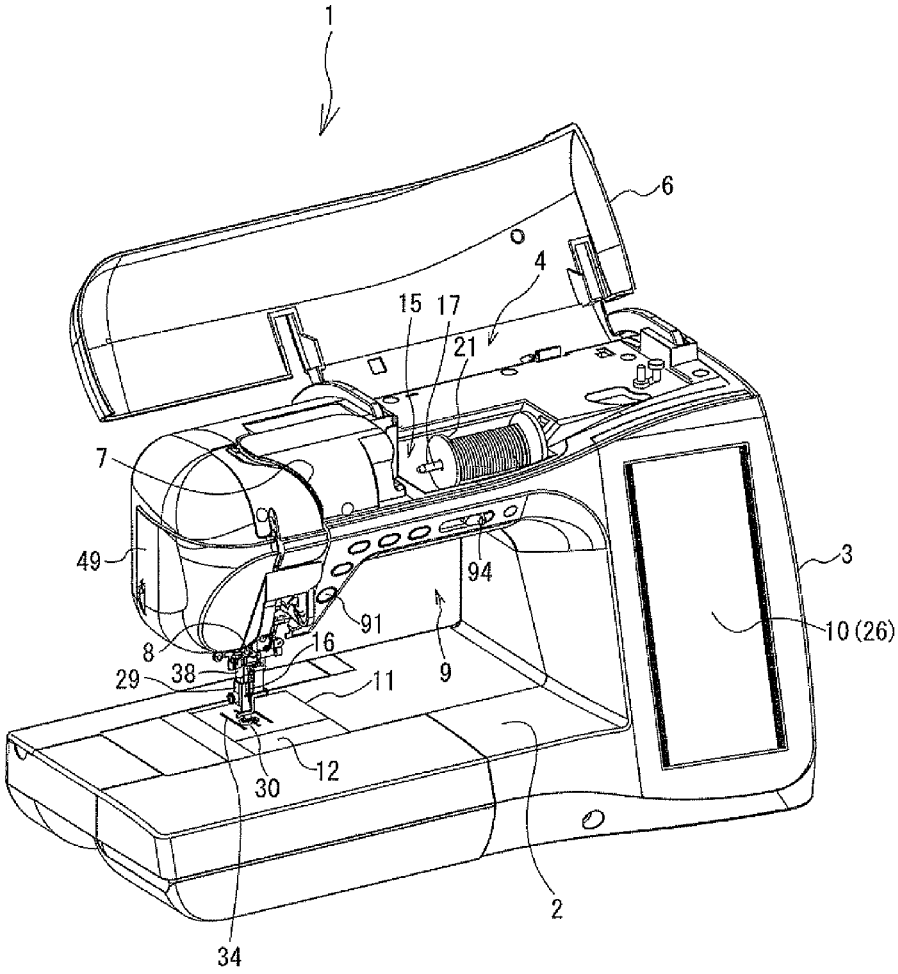
FIG. 1 is a perspective view of a sewing machine.
Figure 2:
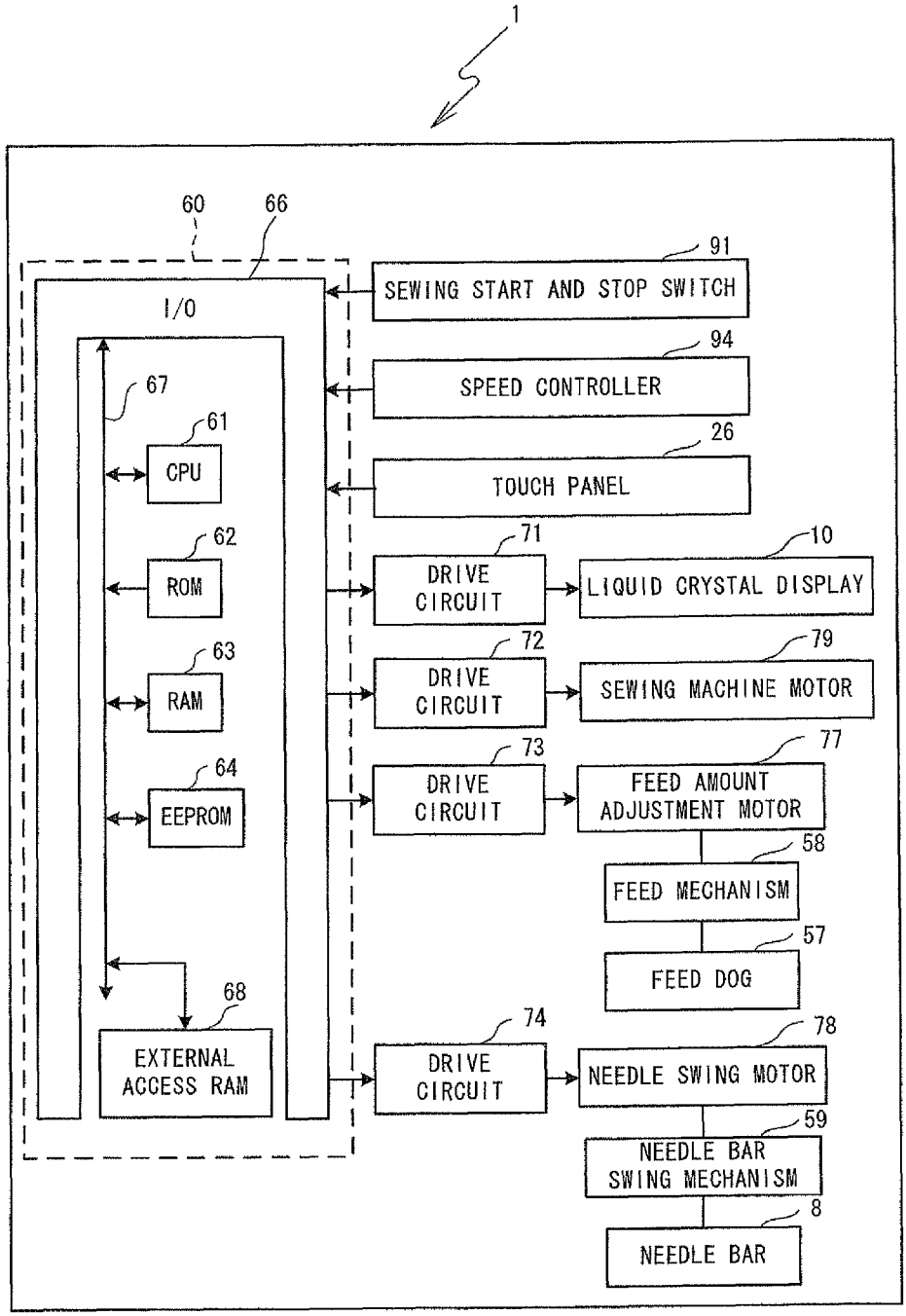
FIG. 2 is a block diagram showing an electrical configuration of the sewing machine.

With reference to FIG. 1 and FIG. 2, a physical structure common to the sewing machine according to the first and second embodiments will be described. In the description below, a lower side diagonally to the left, an upper side diagonally to the right, an upper side diagonally to the left and a lower side diagonally to the right in FIG. 1 respectively correspond to a left side, a right side, a rear and a front of the sewing machine 1.

As shown in FIG. 1, the sewing machine 1 mainly includes a machine bed 2, a pillar 3 and an arm 4. The pillar 3 is vertically arranged in the perpendicular direction from a right end portion of the machine bed 2. The arm 4 extends in the leftward direction from an upper end portion of the pillar 3, such that it is opposite the machine bed 2. A tip portion of the arm 4 is a head portion 49.

A needle plate 11 is provided in the machine bed 2. A rectangular hole 34 is formed in the needle plate 11. A feed dog 57 that will be described later (refer to FIG. 2) can protrude from the rectangular hole 34. A shuttle mechanism (not shown in the figures), the feed dog 57 and a feed mechanism 58 (refer to FIG. 2) are provided inside the machine bed 2 located underneath the needle plate 11. The shuttle mechanism houses a bobbin (not shown in the figures) for a bobbin thread. The feed dog 57 moves a sewing object (for example, a work cloth) in the front-rear direction of the sewing machine 1 by a predetermined movement amount (a feed amount). The feed mechanism 58 is a known mechanism to drive the feed dog 57. For example, Japanese Laid-Open Patent Publication No. 2006-346087 discloses a feed mechanism 58, the relevant portions of which are incorporated herein by reference. A feed amount adjustment motor 77 (refer to FIG. 2) adjusts the movement amount of the feed dog 57, namely, the movement amount of the sewing object, to a predetermined value.

A sewing machine motor 79 (refer to FIG. 2) is provided in the lower portion of the pillar 3. A driving force of the sewing machine motor 79 is transmitted to a drive shaft (not shown in the figures) via a driving belt (not shown in the figures). The drive shaft extends in the left-right direction inside the arm 4. The driving force of the sewing machine motor 79 is also transmitted to a lower shaft (not shown in the figures) by a transmission mechanism (not shown in the figures) that is provided in a center portion of the drive shaft. The lower shaft extends in the left-right direction inside the machine bed 2. With this type of structure, a needle bar 8 that will be described later, a thread take-up mechanism (not shown in the figures), the shuttle mechanism (not shown in the figures) and the feed mechanism 58 etc. can be driven in synchronization.

As shown in FIG. 1, a vertically-long liquid crystal display ("LCD") 10 is provided in the pillar 3. Function names and various types of messages etc. to perform various types of functions required for sewing operations may be displayed on the LCD 10, including such functions as selecting and editing a sewing pattern. A touch panel 26 is provided on a front surface of the LCD 10. In a case where the user selects an item displayed on the LCD 10 using a finger or a touch pen, the touch panel 26 detects the item selected by the user. In this way, the user can input various commands using the LCD 10 and the touch panel 26.

A housing portion 15 is provided in an upper portion of the arm 4. The housing portion 15 is a concave portion that houses a thread spool 21 which an upper thread is wound. The needle bar 8 is provided in a lower portion of the head portion 49. A sewing needle 16 can be mounted at a lower end of the needle bar 8. A presser bar 38 is provided in the rear side of the needle bar 8. A presser holder 29 is installed in a lower end portion of the presser bar 38. A presser foot 30 can be attached to and removed from the presser holder 29. A needle bar up-and-down mechanism (not shown in the figures), a needle bar swing mechanism 59 (refer to FIG. 2) and the thread take-up lever mechanism (not shown in the figures) are provided inside the head portion 49. The needle bar up-and-down mechanism drives the needle bar 8, to which the sewing needle 16 is mounted, in the upward and downward direction. The needle bar swing mechanism 59 is a known mechanism to move the needle bar 8 in the left-right direction. The needle bar swing mechanism 59 can swing a needle bar base (not shown in the figures) in the left-right direction by driving an eccentric swing cam (not shown in the figures). The swing cam can be moved circularly powered by a needle swing motor 78 (refer to FIG. 2) as a power source. The needle bar 8 can be swung in the left-right direction by the needle bar base (not shown in the figures) swinging in the left-right direction.

A thread guide groove 7 is provided in the arm 4. The thread guide groove 7 guides the upper thread that is pulled out from the thread spool 21 to the sewing needle 16 eventually, via a thread tensioner, a thread take-up spring and a thread take-up lever (all of which are not shown in the figures). A plurality of operation keys 9 are provided on a front surface of the arm 4. The plurality of operation keys 9 can be used to make commands that cause various types of sewing operations to be performed. The operation keys 9 include a sewing start-and-stop switch 91 and a speed controller 94, for example. The sewing start-and-stop switch 91 can be used to make a command to start or stop a sewing operation. If the sewing start-and-stop switch 91 is depressed while the sewing operation is stopped, the sewing machine 1 starts the sewing operation. If the sewing start-and-stop switch 91 is depressed while the sewing operation is under way, the sewing machine 1 stops the sewing operation. The speed controller 94 can be used to make a command to adjust a sewing speed (a rotation speed of the sewing machine motor 79).

With reference to FIG. 2, an electrical configuration common to the sewing machine 1 according to the first and second embodiments will be described. As shown in FIG. 2, the sewing machine 1 includes a control portion 60. The control portion 60 includes a CPU 61, a ROM 62, a RAM 63, an EEPROM 64, an external access RAM 68 and an input/output interface 66, and those are connected to one another by a bus 67. The sewing start-and-stop switch 91, the speed controller 94, the touch panel 26 and drive circuits 71 to 74 are all electrically connected to the input/output interface 66. The drive circuit 71 drives the LCD 10. The drive circuit 72 drives the sewing machine motor 79. The drive circuit 73 drives the feed amount adjustment motor 77. The drive circuit 74 can drive the needle swing motor 78.

The CPU 61 manages a main control of the sewing machine 1. The CPU 61 performs various types of calculations and processes in accordance with programs stored in the ROM 62. The ROM 62 can store at least various types of programs and sewing data. The RAM 63 is a storage element that is freely readable and writable. The RAM 63 includes various types of storage areas as required, the storage areas accommodating calculation results processed by the CPU 61. The EEPROM 64 can store at least various types of settings, ready-made sewing data and sewing data generated in accordance with an instruction by the user.

First sewing data generating processing, second sewing data generating processing and sewing processing that can be performed in the sewing machine 1 according to the first embodiment will be described in order. The first sewing data generating processing can generates sewing data that are used for sewing a pattern that has needle drop points at specified relative positions. By operating the touch panel 26, the user can instruct the positions of the needle drop points on a grid displayed on the LCD 10.

The second sewing data generating processing can generates sewing data that may be used for sewing a combined pattern by using the sewing data stored in the ROM 62 or the EEPROM 64. The combined pattern is a pattern in which a plurality of selected patterns are combined in accordance with a set arrangement. In the present embodiment, the arrangement of the patterns is automatically determined in accordance with a selection order of the patterns. The combined pattern that is created in the second sewing data generating processing according to the present embodiment may be a repeated pattern. The repeated pattern is a pattern that is sewn repeatedly in a continuous manner.

In the sewing processing, a pattern can be sewn in accordance with the sewing data stored in the ROM 62 or the EEPROM 64. The sewing data in the first sewing data generating processing, the second sewing data generating processing and the sewing processing are respectively data that can indicate the movement amount of the sewing object fed by the feed dog 57 (refer to FIG. 2) and a swing position of the needle bar 8 by the needle bar swing mechanism 59. In the explanation below, the movement amount of the sewing object by the feed dog 57 is referred to as a feed amount (F). In a case where the feed amount included in the sewing data is a positive value, a movement direction of the sewing object is a direction from the front toward the rear of the sewing machine 1. In a case where the feed amount is a negative value, the movement direction of the sewing object is a direction from the rear toward the front of the sewing machine 1. The swing position of the needle bar 8 swung by the needle bar swing mechanism 59 (refer to FIG. 2) is referred to as a needle swing amount (Z).

Figure 3:
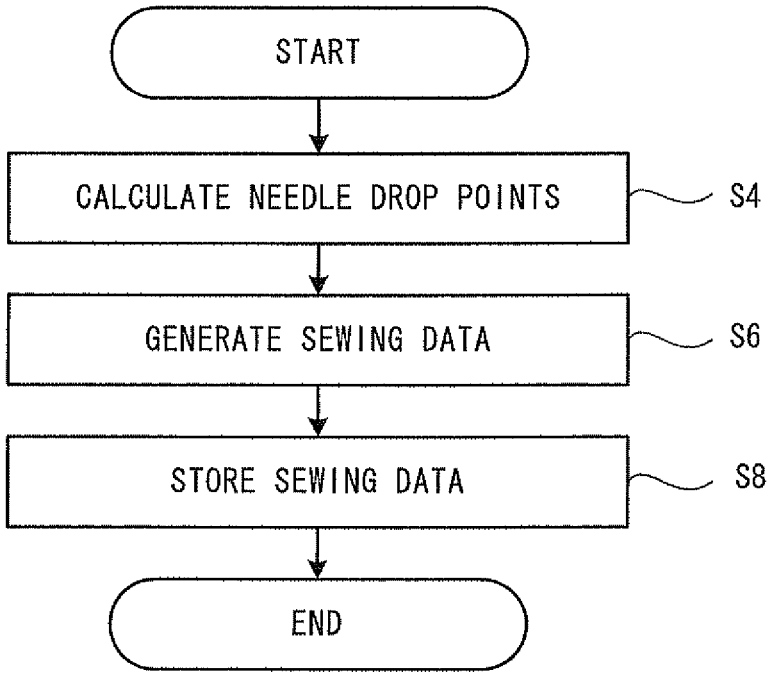
FIG. 3 is a flowchart of first sewing data generating processing.
Figure 4:
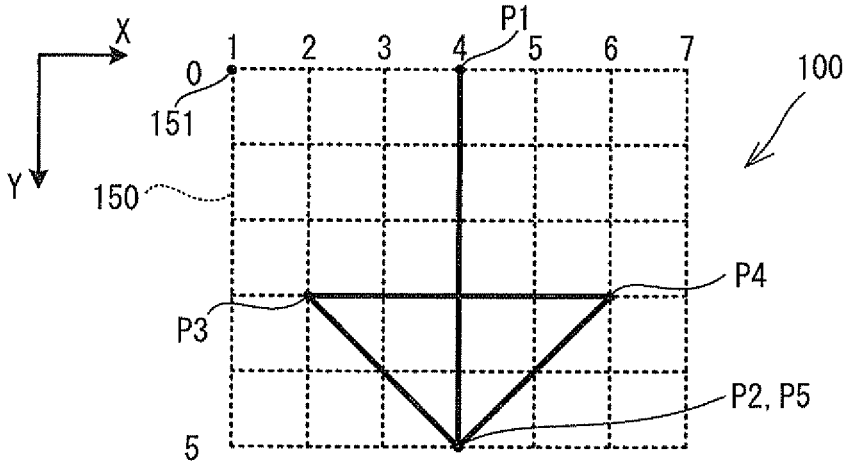
FIG. 4 is an explanatory diagram of a pattern that is generated in the first sewing data generating processing shown in FIG. 3.

With reference to FIG. 3 to FIG. 5, the first sewing data generating processing will be described. Since the first sewing data generating processing is basically similar to a known pattern data creation control, it will herein be briefly described. For example, Japanese Laid-Open Patent Publication No. 2006-43231 discloses pattern data creation control, the relevant portions of which are incorporated herein by reference. A program that performs each processing shown in a flowchart in FIG. 3 is stored in the ROM 62, and the CPU 61 executes the program. The first sewing data generating processing shown in FIG. 3 can be performed in a case where the positions of the needle drop points are specified on the grid displayed on the LCD 10. For example, in a case where the touch panel 26 is operated and an illustration creation mode is selected, it can be possible to specify the position of the needle drop points on the grid.

As shown in FIG. 3, in the first sewing data generating processing, first, a point that is input by operating the touch panel 26 is detected as the needle drop point, and relative coordinates of the needle drop point with respect to a reference point are stored in the RAM 63 (S4). A specific example is assumed in which the user operates the touch panel 26 and inputs points P1 to P5 shown in FIG. 4. In FIG. 4, a grid 150 that is displayed on the LCD 10 is shown by dotted lines. The grid 150 indicates the relative positions of the needle drop points with respect to the reference point. A Y axis direction of the grid 150 shown in FIG. 4 corresponds to the front-rear direction of the sewing machine 1 (a feed direction of the sewing object). An X axis direction of the grid 150 shown in FIG. 4 corresponds to the left-right direction of the sewing machine 1. For example, one cell in the Y axis direction and the X axis direction on the grid 150 corresponds to 1 mm. The reference point may be any point as long as it becomes a reference point that indicates the relative positions of the needle drop points. For example, the reference point is a point 151 (X, Y)=(1, 0) on the grid 150. In the specific example, in the processing at step S4, the relative coordinates of the points P1 to P5 are detected. The relative coordinates of the point P1 are (X, Y)=(4, 0). The relative coordinates of the points P2 and P5 are (X, Y)=(4, 5). The relative coordinates of the point P3 are (X, Y)=(2, 3). The relative coordinates of the point P4 are (X, Y)=(6, 3).

Next, sewing data for sewing a pattern 100 are generated (S6) based on the relative coordinates of the detected needle drop points P1 to P5 with respect to the point 151. As shown in FIG. 4, the pattern 100 is a pattern created by connecting the points P1 to P5 in order. In the specific example, sewing data 170 for sewing the pattern 100 are generated as shown in FIG. 5. The sewing data 170 include a data number (n), a feed amount ($F_n$) and a needle swing amount ($Z_n$). The variable number n indicates a data number that is a sewing order of the needle drop points. A value of n is a natural number. Data numbers 1 to 5 respectively correspond to the points P1 to P5. In a case where the value of n is 1, the Y coordinate of the point P1 is set as the feed amount ($F_n$). In a case where the value of n is larger than 1, (a Y coordinate of a point Pn)−(a Y coordinate of a point P(n−1)) is set as the feed amount ($F_n$). Regardless of the value of n, an X coordinate of the point Pn is set as the needle swing amount ($Z_n$). Next, in the second sewing data generating processing described below, the generated sewing data 170 is stored in the EEPROM 64 in an acquirable manner (S8). In the processing at step S8, image data for displaying a thumbnail image 101 (refer to FIG. 7) on the LCD 10 are generated using a known method, the thumb nail image 101 representing the pattern 100. The generated image data are stored in the RAM 63 while being associated with the sewing data 170. This completes the first sewing data generating processing.

Figure 6:
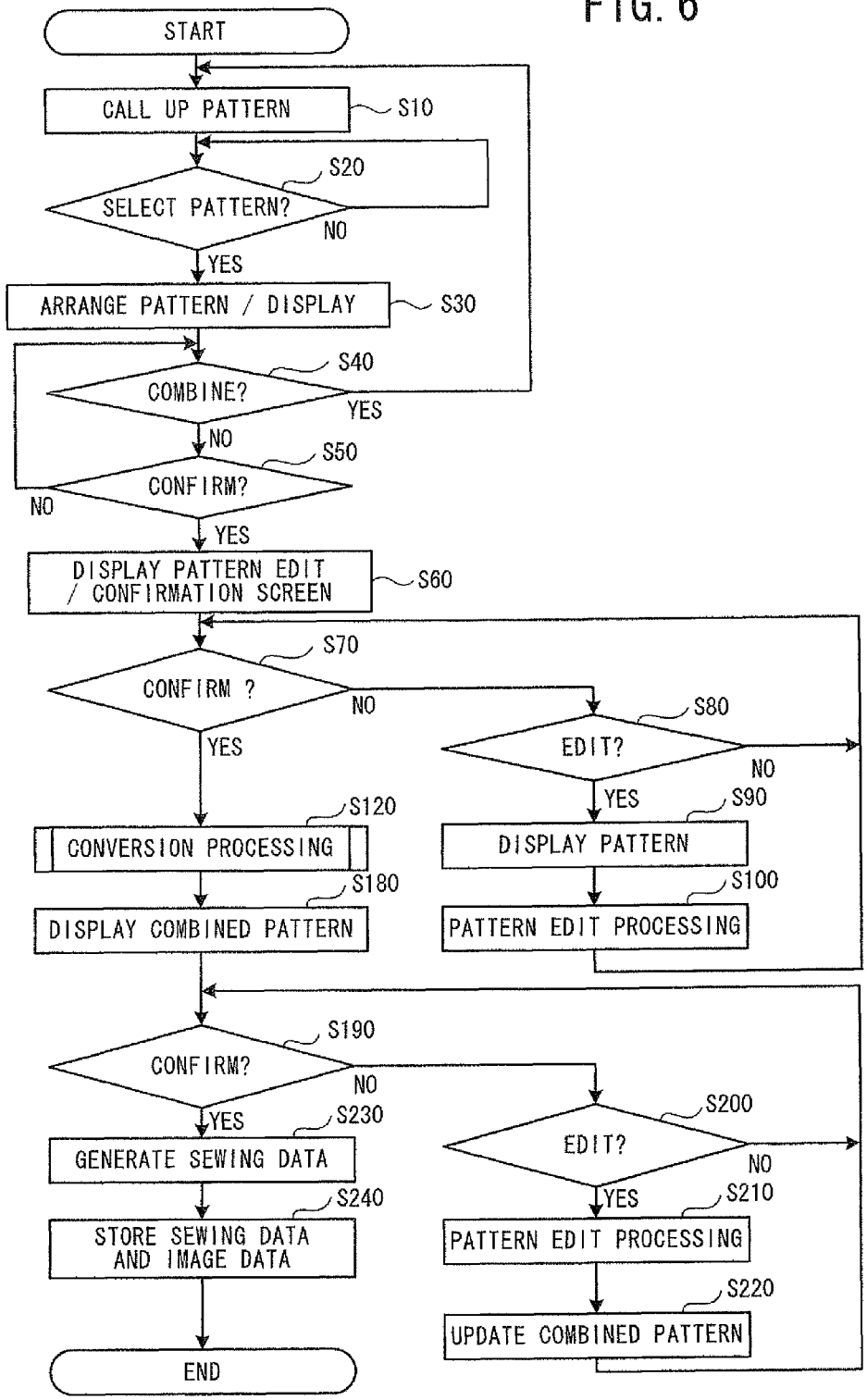
FIG. 6 is a flowchart of second sewing data generating processing.

With reference to FIG. 6 to FIG. 21, the second sewing data generating processing will be described. A program that performs each processing shown in a flowchart in FIG. 6 is stored in the ROM 62, and the CPU 61 executes the program. The second sewing data generating processing in FIG. 6 can be performed in a case where the touch panel 26 is operated and a combined pattern creation mode is selected. In the description below, various types of images can be displayed on the LCD 10 based on a control signal that is output to the drive circuit 71. Various types of keys included in the various types of images can be selected by operating the touch panel 26.

Figure 7:
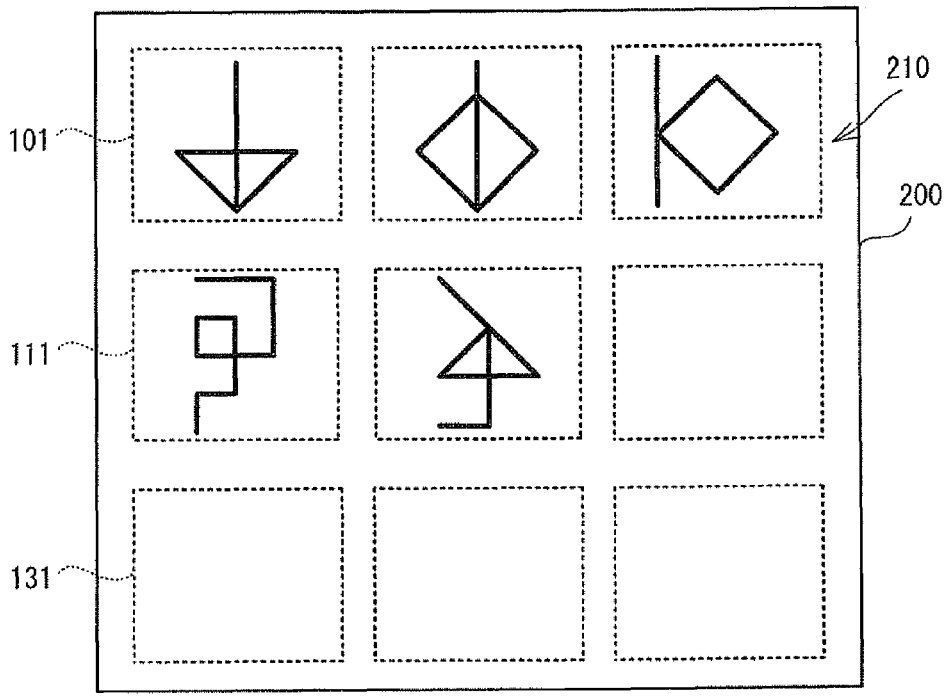
FIG. 7 is an explanatory diagram of a pattern call-up screen.
Figure 8:
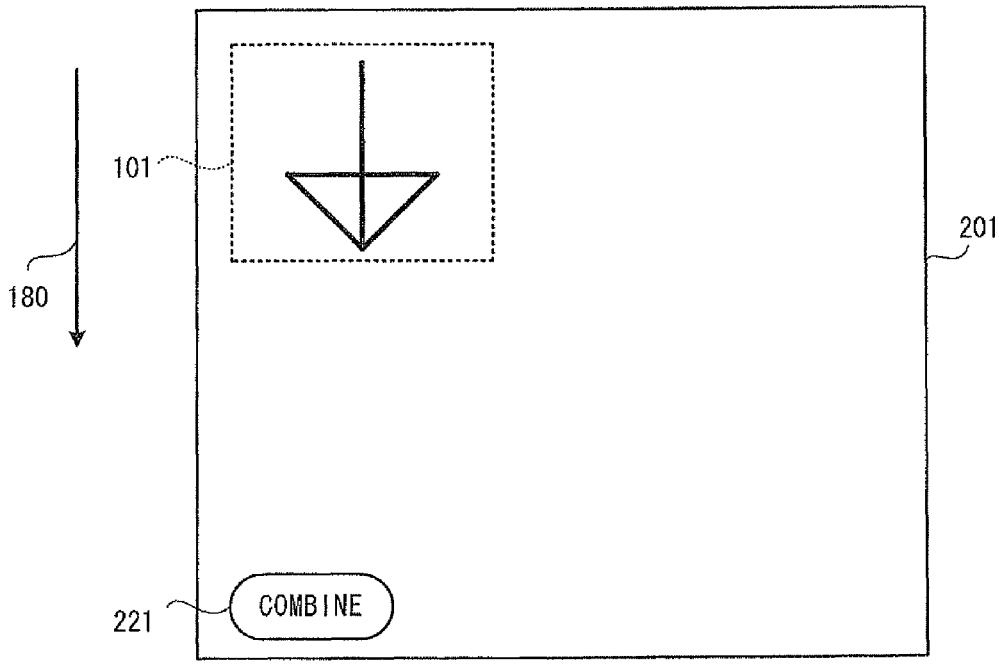
FIG. 8 is an explanatory diagram of a pattern display screen.
Figure 9:
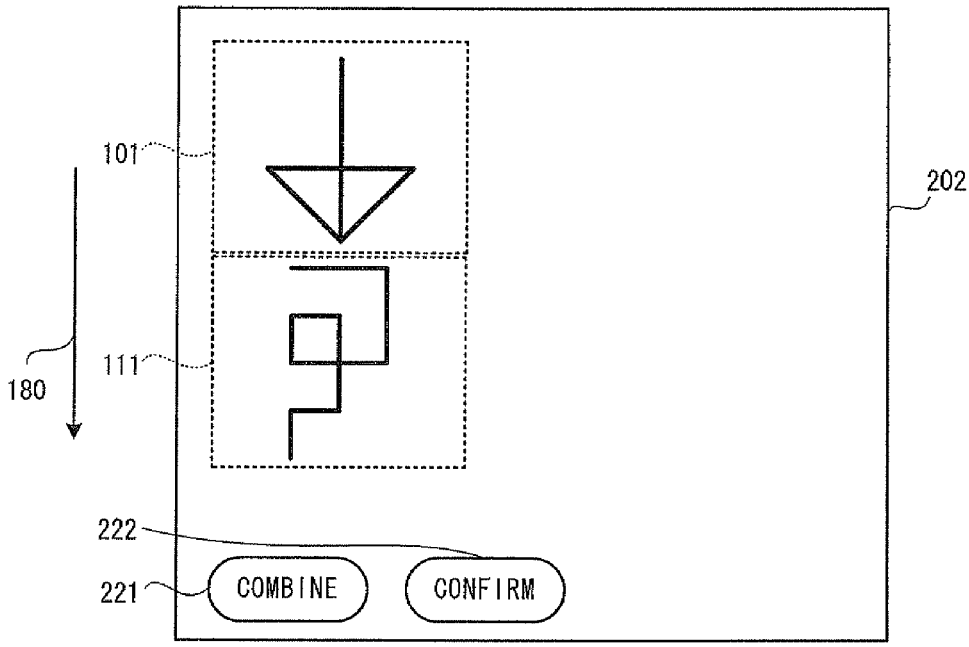
FIG. 9 is an explanatory diagram of a pattern display/combination screen.

As shown in FIG. 6, in the second sewing data generating processing, the image data mapped to the sewing data stored in the ROM 62 or the EEPROM 64 are called up (S10). The sewing data stored in the ROM 62 may be ready-made sewing data stored before the shipment of the sewing machine 1. The sewing data stored in the EEPROM 64 include the ready-made sewing data and the sewing data generated in accordance with the instruction by the user in the first sewing data generating processing. In the specific example, in the processing at step S10, a pattern call-up screen 200 (a "screen 200") exemplified in FIG. 7 is displayed based on the called up image data. As shown in FIG. 7, the screen 200 includes a pattern display area 210. A plurality of thumbnail images, including thumbnail images 101, 111 and 131, are displayed in the pattern display area 210. The thumbnail image 101 represents a shape of the pattern 100 shown in FIG. 4. The thumbnail image 111 represents a shape of a pattern 110 described later with reference to FIG. 10. The thumbnail image 131 shows a free space in which the sewing data generated in the first sewing data generating processing can be stored. In the specific example in FIG. 7, it is possible to store sewing data respectively corresponding to 4 more additional patterns.

Next, the CPU 61 stands by (no at step S20) until any one of the displayed thumbnail images is selected. In the present embodiment, it is assumed that the thumbnail image 101 is selected as a first pattern of a combination order (yes at step S20). The combination order represents a sewing order of the patterns that is determined based on an arrangement between a plurality of patterns. The sewing machine 1 according to the present embodiment automatically sets the combination order in accordance with a selection order of the patterns, such that selected patterns are arranged and sewn in order in the direction from the rear to the front of the sewing machine 1 (in the direction indicated by an arrow 180 in FIG. 8). Therefore, in the present embodiment, the combination order corresponds to the selection order of the patterns. In a case where the thumbnail image 101 is selected (yes at step S20), an arrangement of the selected patterns is automatically set, and a pattern display screen 201 shown in FIG. 8 (a "screen 201") is displayed (S30). The thumbnail image 101 selected in the processing at step S20 and a combination key 221 are displayed on the screen 201. The combination key 221 can be used to make a command to select an additional pattern.

Figure 10:
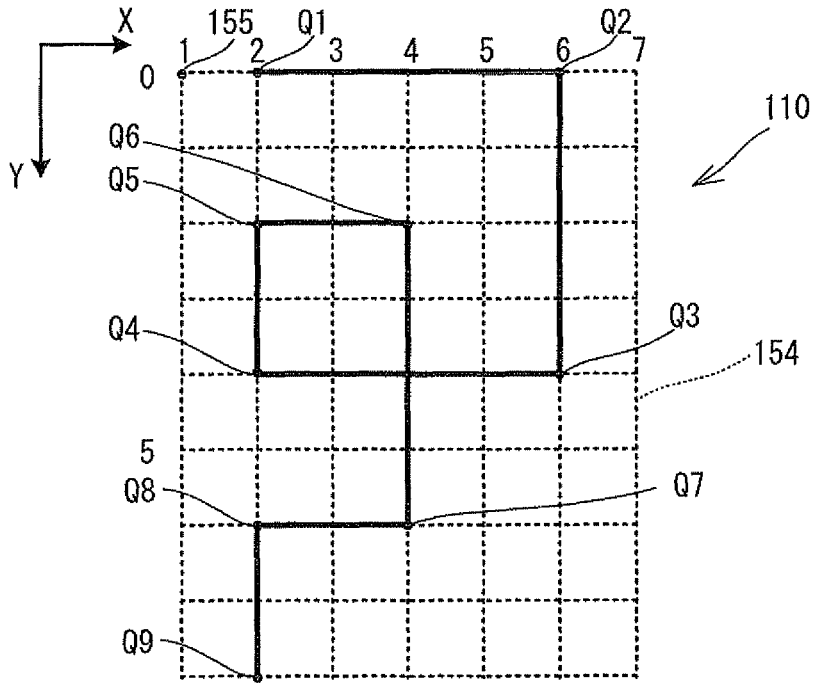
FIG. 10 is an explanatory diagram of a pattern.

A confirm key described later is not displayed on the screen 201 that is displayed in a case where the first pattern in the combination order is selected. Therefore, the CPU 61 stands by (no at step S40 and no at step S50) until the combination key 221 is selected. In a case where the combination key 221 is selected (yes at step S40), the processing returns to step S10 and the processing of selecting patterns is repeated. In the processing at step S20 performed after a second cycle, a substantially similar pattern or a different pattern to an already-selected pattern may be selected. In the specific example, it is assumed that the thumbnail image 111 is selected in the second cycle of the processing at step S20 (yes at step S20). The thumbnail image 111 corresponds to the pattern 110 (refer to FIG. 10). As shown in FIG. 10, the pattern 110 includes 9 needle drop points Q1 to Q9 arranged on a grid 154 that is substantially similar to the grid 150 shown in FIG. 4. Relative coordinates of the points Q1 to Q9 with respect to a reference point 155 are respectively (X, Y) (2, 0), (6, 0), (6, 4), (2, 4), (2, 2), (4, 2), (4, 6), (2, 6) and (2, 8).

Image data that represent the thumbnail image 111 can be stored in the ROM 62 or the EEPROM 64, while being associated with the sewing data 171 shown in FIG. 11 that can be used for sewing the pattern 110. In this case, in the processing at step S30, a pattern display/combination screen 202 exemplified in FIG. 9 (a "screen 202") is displayed. On the screen 202, the direction indicated by the arrow 180 corresponds to the direction from the rear to the front of the sewing machine 1 (a positive movement direction). The direction indicated by the arrow 180 is regarded as an up-down direction of the screen. On the screen 202, the thumbnail image 101 of the pattern 100 that is selected in the first cycle of the processing and the thumbnail image 111 of the pattern 110 that is selected in the second cycle of the processing are arranged in order from the top to the bottom of the screen. A pattern arranged on the top side of the screen has an earlier sewing order compared with a pattern arranged on the bottom side of the screen. On the screen 202, the combination key 221 that is substantially similar to that on the screen 201 shown in FIG. 8 and a confirm key 222 are displayed. The confirm key 222 can be used to end the selection of patterns used for creating the combined pattern.

Figure 12:
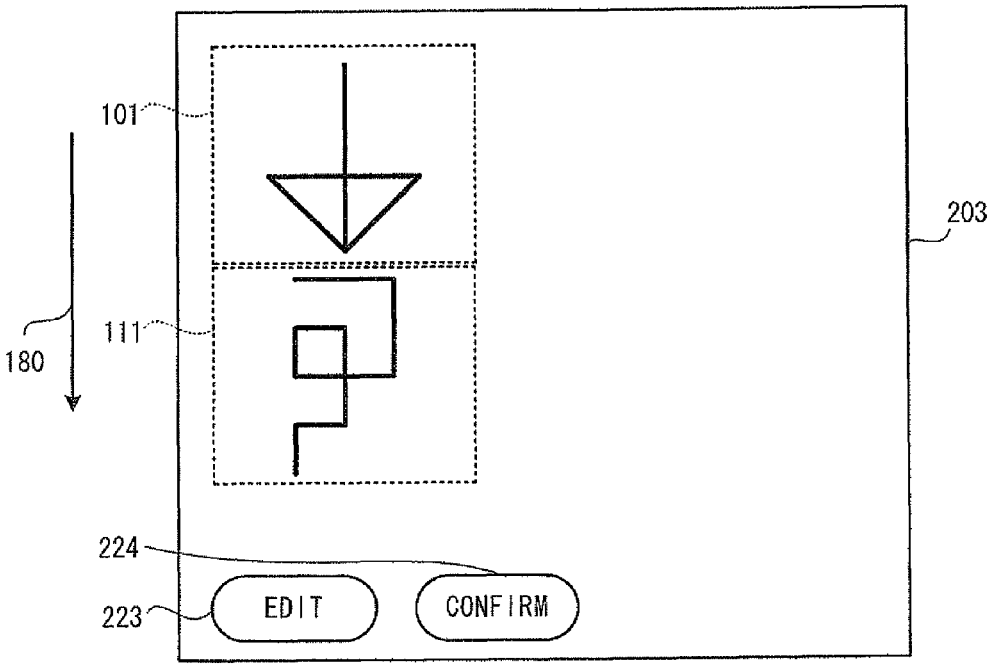
FIG. 12 is an explanatory diagram of a pattern edit/confirmation screen.
Figure 13:
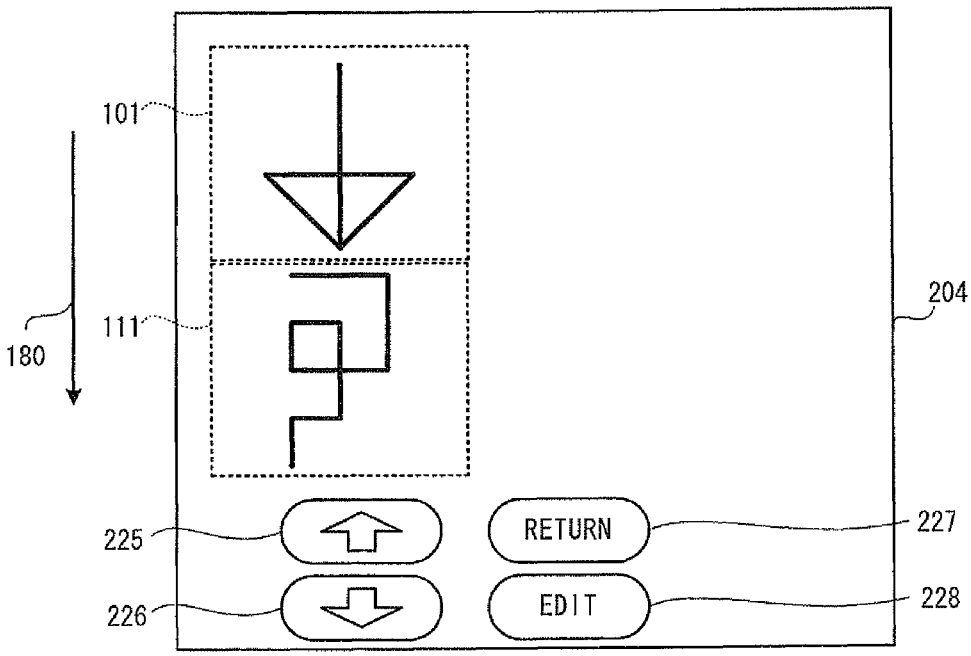
FIG. 13 is an explanatory diagram of a pattern display screen.

In a case where the combination key 221 is selected (yes at step S40), the processing returns to step S10 and the processing of selecting patterns is repeated. In a case where the confirm key 222 is selected (yes at step S50), a pattern editing/confirmation screen 203 (a "screen 203") exemplified in FIG. 12 is displayed (S60). On the screen 203, the thumbnail image 101 that is substantially similar to that on the screen 202, the thumbnail image 111, an edit key 223, and a confirm key 224 are displayed. The edit key 223 can be used to make a command to switch modes to a mode for editing one of patterns that have been selected. The confirm key 224 can be used to make a command to generate sewing data for sewing the combined pattern. The CPU 61 stands by (no at step S70 and no at step S80) until one of the edit key 223 and the confirm key 224 is selected. In a case where the edit key is selected (no at step S70 and yes at step S80), a pattern display screen 204 (a "screen 204") shown in FIG. 13 is displayed (890). The screen 204 is a screen on which an edit target pattern is selected from among a plurality of patterns that have been selected.

Figure 14:
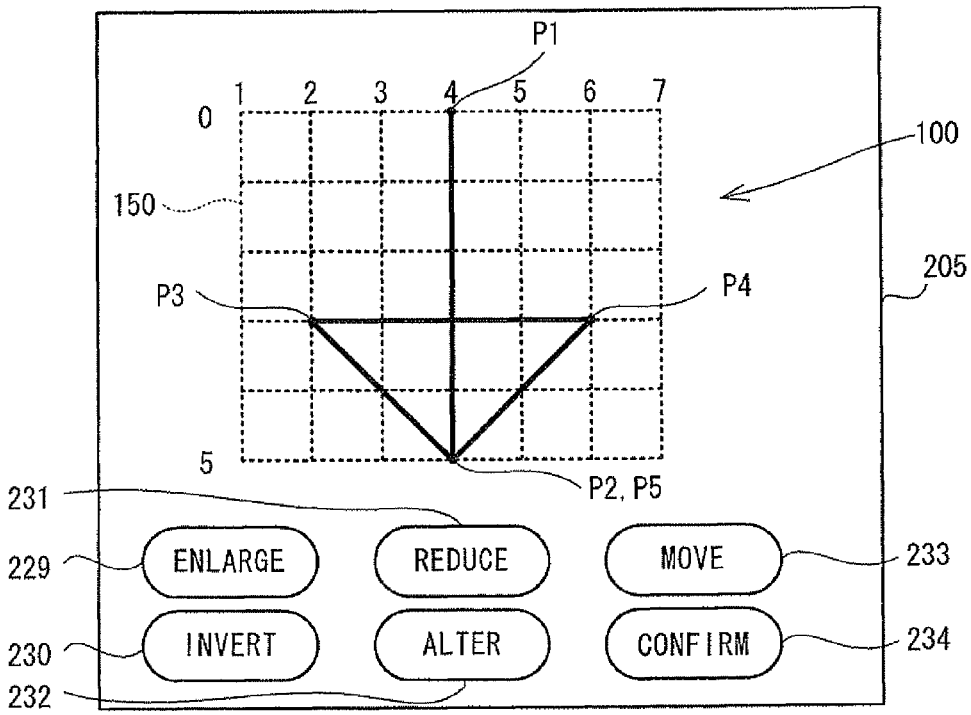
FIG. 14 is an explanatory diagram of a pattern edit screen.

Next, the CPU 61 performs pattern edit processing (S100). In the pattern edit processing, various types of processes can be performed to change relative positions of needle drop points of the edit target pattern with respect to the reference point. For example, the pattern edit processing can be performed in the following manner. In the pattern edit processing, a thumbnail image that represents the edit target pattern can be selected by using separate pattern selection keys 225 and 226 displayed on the screen 204. In the specific example, it is assumed that the thumbnail image 101 corresponding to the pattern 100 is selected. Next, in a case where an edit key 228 is selected, a pattern edit screen 205 (a "screen 205") that is exemplified in FIG. 14 is displayed to edit the pattern 100 that has been selected. On the screen 205, needle drop points P1 to P5 of the pattern 100 are arranged on the grid 150 that is substantially similar to FIG. 4. On the screen 205, an enlarge key 229, an invert key 230, a reduce key 231, an alter key 232, a move key 233 and a confirm key 234 can be respectively displayed. One of the edit processes, including enlarge, invert, reduce, alter shape and move, can be performed on the pattern 100 in accordance with a selected key. Since the above-described edit processing is publicly known, a detailed description thereof is omitted. In the specific example, it is assumed that none of the edit processes has been performed. In a case where the confirm key 234 is selected, the edit processing is terminated and the screen 204 that is exemplified in FIG. 13 is displayed. In a case where a return key 227 in FIG. 13 is selected, the pattern edit processing is terminated and the processing returns to step S70.

In a case where the confirm key 224 is selected (yes at step S70), conversion processing is performed (S120). In the conversion processing, vector data that represent a combined pattern are generated based on sewing data respectively corresponding to the plurality of patterns that have been selected. The vector data are expressed by the relative positions of the needle drop points of the combined pattern with respect to the reference point. In the present embodiment, the vector data can be expressed by XY coordinate-based numerical values that are exemplified on the grid 150 in FIG. 4. A vector from one needle drop point toward the next needle drop point indicates a direction of a stitch that is formed. The reference point may be any point as long as it becomes a reference point that indicates the relative positions of the needle drop points of the combined pattern. In the present embodiment, a point (X, Y)=(1, 0) on the grid 152 that is exemplified in FIG. 16 is regarded as a reference point 153.

Figure 15:
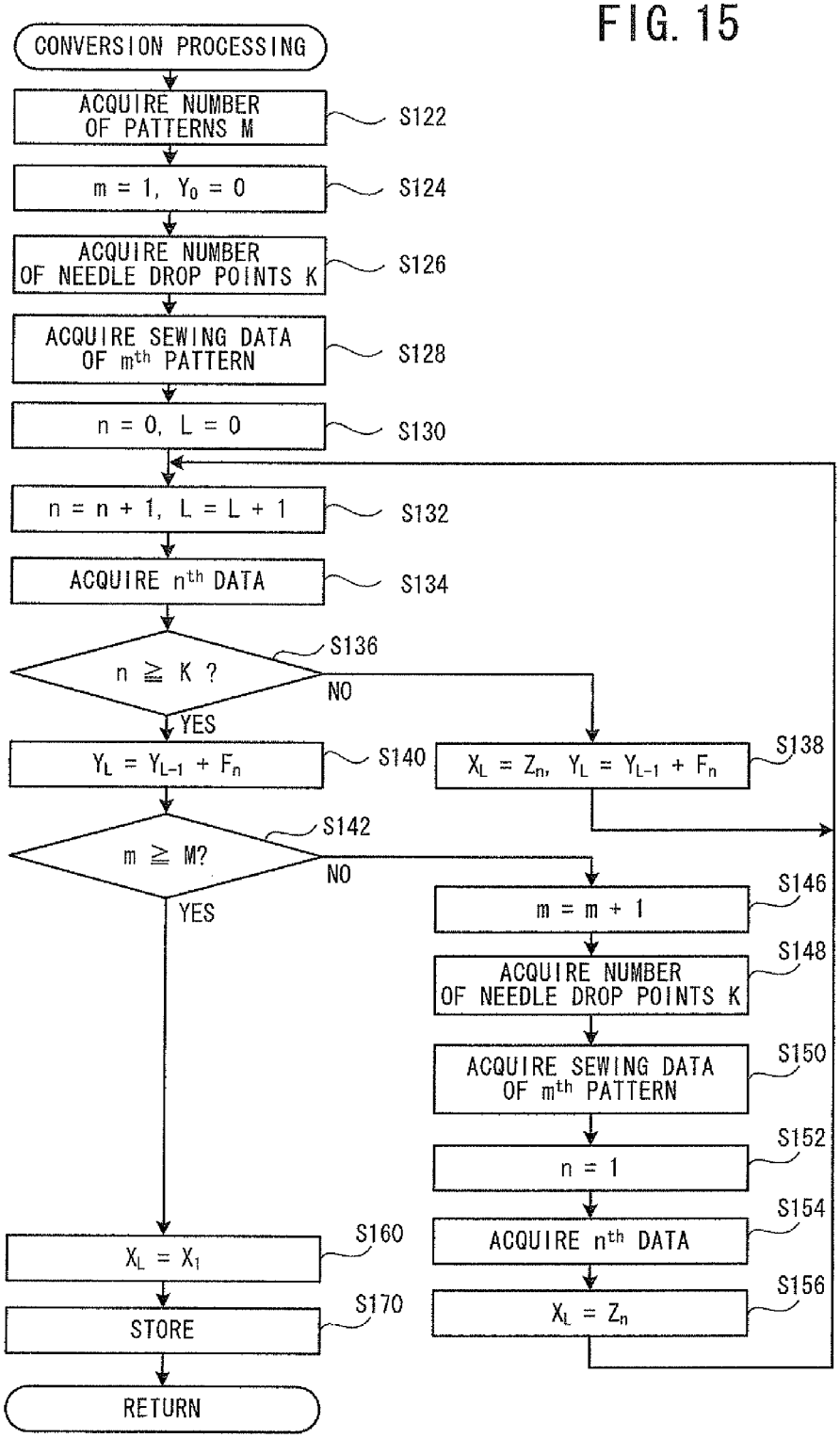
FIG. 15 is an explanatory diagram of conversion processing according to a first embodiment, the conversion processing being performed in the second sewing data generating processing shown in FIG. 6.
Figure 16:
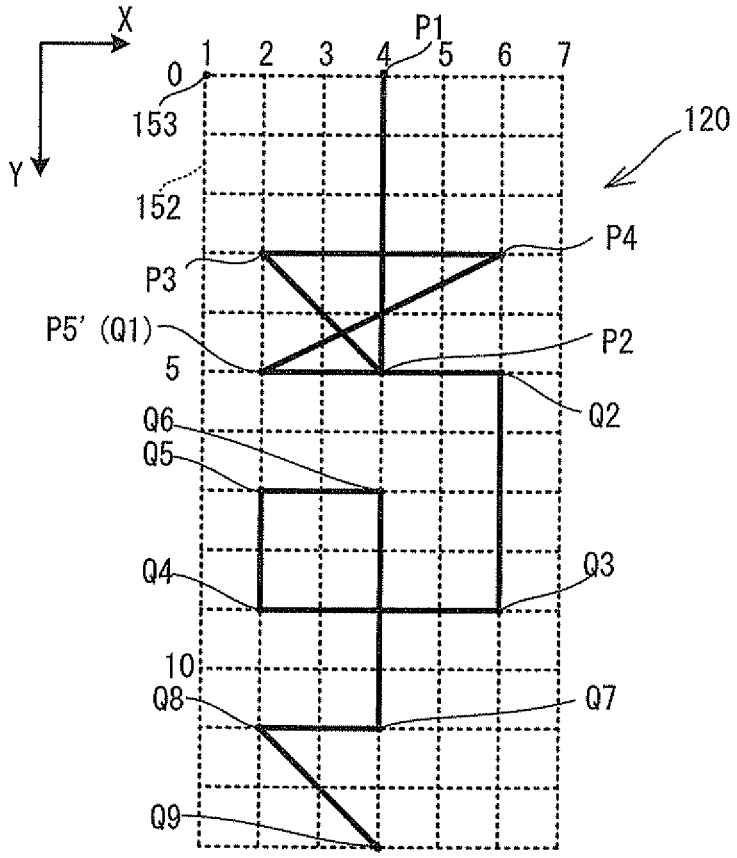
FIG. 16 is an explanatory diagram of a combined pattern.

With reference to FIG. 15 to FIG. 17, the conversion processing will be described in detail. As shown in FIG. 15, in the conversion processing, first, a number of patterns M is acquired. The number of patterns M is a number of the patterns that has been selected. The acquired number of patterns M is stored in the RAM 63 (S122). In the specific example, a number of patterns M is 2. Next, 1 is set as a variable number m and 0 is set as $Y_0$, and the set variable number in and $Y_0$ are stored in the RAM 63 (S124). The variable number m is a variable number that can be used to read out the selected patterns in accordance with the combination order. $Y_0$ is a value of a Y coordinate at a time in a case where sewing is started. In the present embodiment, $Y_0$ is 0. Next, based on the sewing data 170 shown in FIG. 5, a number of needle drop points K of a first (m=1) pattern is acquired, and the number of needle drop points K is stored in the RAM 63 (S126). In the specific example, the number of needle drop points K is 5. Next, by referring to the EEPROM 64, the sewing data 170 of the first (m=1) pattern 100 is acquired, and the acquired sewing data 170 are stored in the RAM 63 (S128). Next, 0 is set as n and L respectively, and the set n and L are stored in the RAM 63 (S130). n is the data number included in sewing data for sewing an $m^{th}$ pattern. Further, n is a variable number that can be used for calling up a data line of a data number n in order. L is a variable number that represents the sewing order of the sewing data that represent the combined pattern.

Next, n and L are respectively incremented and then stored in the RAM 63 (S132). Next, the data line of the data number n of the $m^{th}$ sewing data that are stored in the RAM 63 is acquired, the $m^{th}$ sewing data being acquired at step S128 or at step S150 described later. The acquired data line is stored in the RAM 63 (S134). In the specific example, in a case where m=1 and n=1, a data line corresponding to a data number 1 is acquired from among the sewing data 170 shown in FIG. 5. In this case, since n is not equal to or larger than K (no at step S136), $Z_n$ is set as $X_L$ and $(Y_{L-1}+F_n)$ is set as $Y_L$. The set $X_L$ and $Y_L$ are stored in the RAM 63 (S138). $Y_L$ represents a y coordinate of the $L^{th}$ needle drop point of the combined pattern. $Y_{L-1}$ represents a y-coordinate of the $(L-1)^{th}$ needle drop point of the combined pattern. $X_L$ represents an x-coordinate of the $L^{th}$ needle drop point of the combined pattern. In the specific example, as shown by vector data 173 shown in FIG. 17, in a case where m=1 and n=1, then $(X_1, Y_1)$ $(Z_1, Y_0+F_1)$=(4, 0). Next, the processing returns to step S132.

In the specific example, under a condition in which m=1, in a case where processing at step S132 is repeatedly performed and n becomes 5 (yes at step S136), $(Y_{L-1}+F_n)$ is set as $Y_L$. The set $Y_L$ is stored in the RAM 63 (S140). In this case, since m is not equal to or larger than M (no at step S142), m is incremented and then stored in the RAM 63 (S146). Next, 9 is acquired as the number of needle drop points K of the second pattern 110 (refer to FIG. 10) by substantially similar processing to that at step S126 and at step S128. After that, the sewing data 171 (refer to FIG. 11) for sewing the pattern 110 are acquired (S150). Next, 1 is set as n, and the set n is stored in the RAM 63 (S152).

Next, a data line of the data number 1 is acquired from among the sewing data 171 (S154) by processing that is substantially similar to the processing at step S134. Next, $Z_n$ is set as $X_L$, and the set $X_L$ is stored in the RAM 63 (S156). As shown in FIG. 16, a point P5' is matched with a point Q1 in a combined pattern 120 by the processing at step S140 and the processing at step S156. More specifically, by the processing at step S156, the last needle drop point P5 in the sewing order of the pattern 100 is changed to the point P5', the pattern 100 is the first ($N^{th}$) pattern in the combination order. As a result, the point P5' after the change is matched with the needle drop point Q1 that is the first needle drop point in the sewing order of the pattern 110, the pattern 110 is the second ($N+1^{th}$) pattern in the combination order. Next, the processing returns to step S132.

In the repeatedly performed processing at step S142, in the case that m is 2 (yes at step S142), the $m^{th}$ pattern is the last pattern in the combination order. In this case, $X_1$ is set as $X_L$, and the set $X_L$ is stored in the RAM 63 (S160). Therefore, a relative position of the needle drop point P1 in the x axis direction with respect to the reference point 153 is matched with a relative position of the needle drop point Q1 in the x axis direction with respect to the reference point 153. The needle drop point P1 is the first needle drop point of the combined pattern 120. The needle drop point Q1 is the last needle drop point of the combined pattern 120. The processing at step S160 is performed in a case where the combined pattern is a repeated pattern. Next, data from $(X_1, Y_1)$ to $(X_L, Y_L)$ are stored as the vector data in the EEPROM 64 (S170). In the specific example, the vector data 173 shown in FIG. 17 can be generated by the conversion processing and then stored in the EEPROM 64. This completes the conversion processing, and the processing returns to the second sewing data generating processing shown in FIG. 6.

Figure 18:
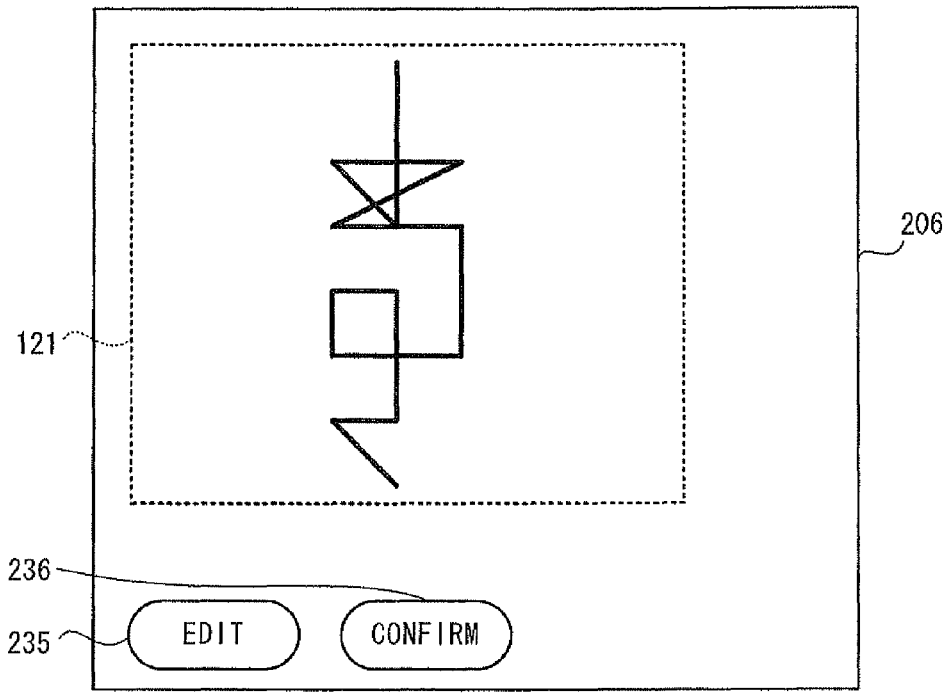
FIG. 18 is an explanatory diagram of a combined pattern display screen.

Next, based on the vector data generated in the processing at step S120, image data of a thumbnail image 121 (refer to FIG. 18) can be generated, the thumbnail image 121 representing the combined pattern 120. Based on the generated image data, a combined pattern display screen 206 (a "screen 206") shown in FIG. 18 is displayed (S180). The thumbnail image 121, an edit key 235 and a confirm key 236 are displayed on the screen 206. The edit key 235 can be used to make a command to change the relative position of the needle drop point of the combined pattern 120 that is represented by the thumbnail image 121. The confirm key 236 can be used to make a command to generate sewing data 172 of the combined pattern 120 that is represented by the thumbnail image 121. The user can verifies a shape of the combined pattern 120 by checking the thumbnail image 121 displayed on the screen 206.

The CPU 61 stands by (no at step S190 and no at step S200) until one of the edit key 235 and the confirm key 236 is selected. In a case where the edit key 235 is selected (yes at step S200), pattern edit processing is performed (S210). In the pattern edit processing at step S210, the relative position of the needle drop point of the combined pattern 120 with respect to the reference point 153 can be changed. For example, a screen substantially similar to the screen 205 shown in FIG. 14 is displayed, and a pattern is edited in accordance with a selected select key. Next, the screen 206 is updated (S220) based on vector data that represent the combined pattern that has been edited. Next, the processing returns to step S190. In the specific example, it is assumed that the combined pattern 120 is changed to a pattern 130 shown in FIG. 19 by the pattern edit processing at step S210. In this case, the vector data 173 (refer to FIG. 17) of the combined pattern 120 are changed to vector data 175 shown in FIG. 20 by the pattern edit processing.

In a case where the confirm key 236 is selected (yes at step S190), the sewing data for sewing the combined pattern are generated, and the generated sewing data are stored in the RAM 63 (S230). In a case in which the pattern edit processing is performed at step S210, the sewing data are generated based on the vector data edited by the pattern edit processing. Processing of converting the vector data into the sewing data is substantially similar to the processing at step S6 shown in FIG. 3. In the specific example, sewing data 174 can be generated based on the vector data 175 $(X_n, Y_n)$ shown in FIG. 20, the sewing data 174 including the data number (n), the feed amount $(F_n)$ and the needle swing amount $(Z_n)$. In a case where the pattern edit processing is not performed at step S210, the sewing data are generated based on the vector data generated by the conversion processing at step S120. In the specific example, in a case where the pattern edit processing has not been performed, the sewing data 172 are generated based on the vector data 173 $(X_n, Y_n)$ shown in FIG. 17, the sewing data 172 including the data number (n), the feed amount $(F_n)$ and the needle swing amount $(Z_n)$.

Next, the generated sewing data and the image data corresponding to the sewing data are stored in the EEPROM 64 as retrievable data by the processing at step S10 (S240). This completes the second sewing data generating processing. In the second sewing data generating processing that is subsequently performed, a pattern call-up screen 207 (a "screen 207") in FIG. 21, for example, can be displayed in the processing at step S10 instead of the pattern call-up screen 200 shown in FIG. 7. On the screen 207, the thumbnail image 121 that represents the shape of the combined pattern 120 can be displayed based on the image data stored by the processing at step S240. Therefore, in the second sewing data generating processing that is subsequently performed, the user can create a combined pattern by combining the combined pattern 120 with other patterns.

The sewing processing will be described with reference to FIG. 22. A program that causes each processing shown in a flowchart in FIG. 22 to be performed is stored in the ROM 62 shown in FIG. 2, and the CPU 61 executes the program. The sewing processing is performed in a case where the touch panel 26 is operated and a sewing mode is set.

Figure 22:
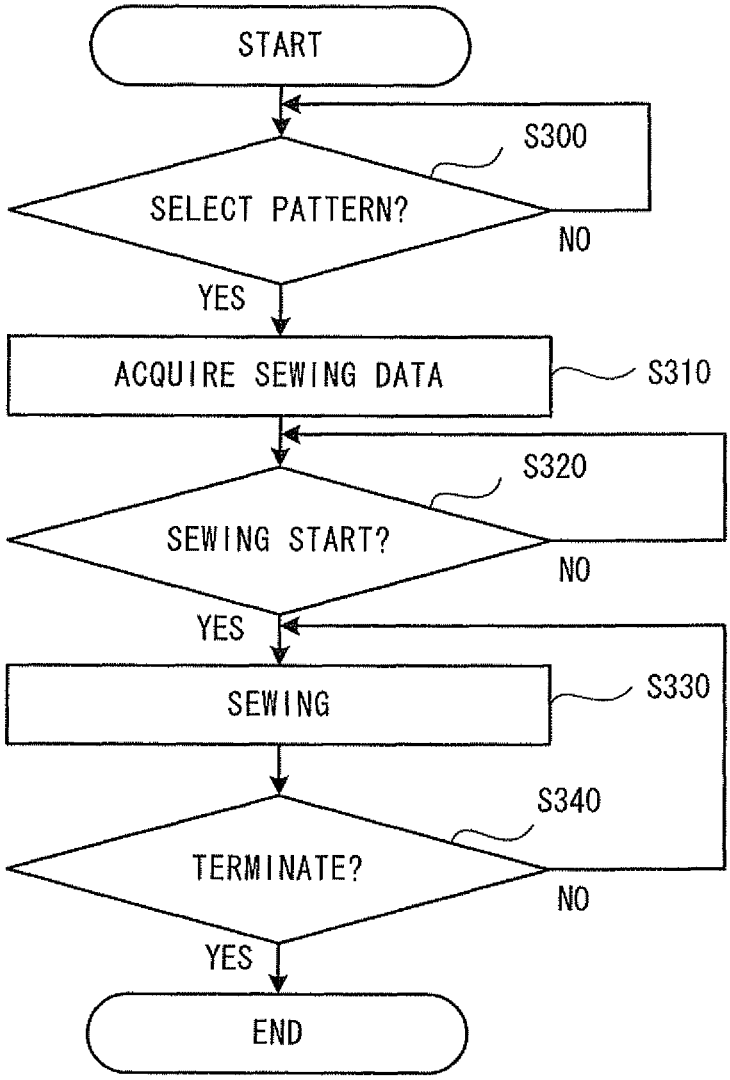
FIG. 22 is a flowchart of sewing processing.

As shown in FIG. 22, in the sewing processing, the CPU stands by (no at step S300) until a sewing target pattern is selected. The sewing target pattern can be selected from among patterns that may be sewn based on the sewing data stored in the ROM 62 and the EEPROM 64. Selectable patterns at least include patterns that may be sewn based on the sewing data generated by first sewing data generating processing and combined patterns that may be sewn based on the sewing data generated by second sewing data generating processing. In a case where the combined pattern 120 is selected (yes at step S300), the sewing data 172 for sewing the selected combined pattern 120 are acquired, and the acquired sewing data 172 are stored in the RAM 63 (S310). Next, the CPU 61 stands by (no at step S320) until the sewing start-and-stop switch 91 is depressed.

In a case where the sewing start-and-stop switch 91 is depressed (yes at step S320), a control signal is output from the drive circuit 72 to the drive circuit 74 based on the sewing data acquired at step S310, and the sewing is performed (S330). After the sewing is started, the processing at step S330 is performed for as long as the sewing start-and-stop switch 91 is not depressed (no at step S340). In the specific example, in a case where the combined pattern 120 is sewn based on the sewing data 172 shown in FIG. 17, in the first cycle of the processing, data lines of the data numbers 1 to 13 are called up in order, and the sewing is performed. In the processing subsequent to the first cycle, the data lines of the data numbers 2 to 13 are called up in order while omitting the data line of the data number 1, and the sewing is performed. After the sewing started, in a case where the sewing start-and-stop switch 91 is depressed (yes at step S340), the sewing processing is terminated.

In a case where new sewing data for sewing a combined pattern are generated based on the sewing data stored in the ROM 62 or the EEPROM 64, it is possible to generate a new combined pattern based on the new sewing data by using the sewing machine 1. Therefore, with the sewing machine 1, usability for the user can be improved in a case where the user newly creates the sewing data of the combined pattern. With the sewing machine 1, the combined pattern can be edited as a single pattern by temporarily converting the sewing data into the vector data. Therefore, with the sewing machine 1, the usability for the user can be improved in a case where the user edits the sewing data of the combined pattern. With the sewing machine 1, the user can generate the sewing data that represent the combined pattern using the sewing data that have been generated (by specifying the relative positions of the needle drop points with respect to the reference point using the first sewing data generating processing shown in FIG. 3) to sew the pattern. With the sewing machine 1, an end point of the $N^{th}$ pattern in the combination order can be automatically matched up with a start point of the $(N+1)^{th}$ pattern in the combination order. With the sewing machine 1, in a case where the combined pattern is a repeated pattern, the relative positions of the start and end points of the combined pattern can be automatically matched with in the left-right direction of the sewing machine 1 (the swing direction of the needle bar 8 by the needle bar swing mechanism 59).

Figure 19:
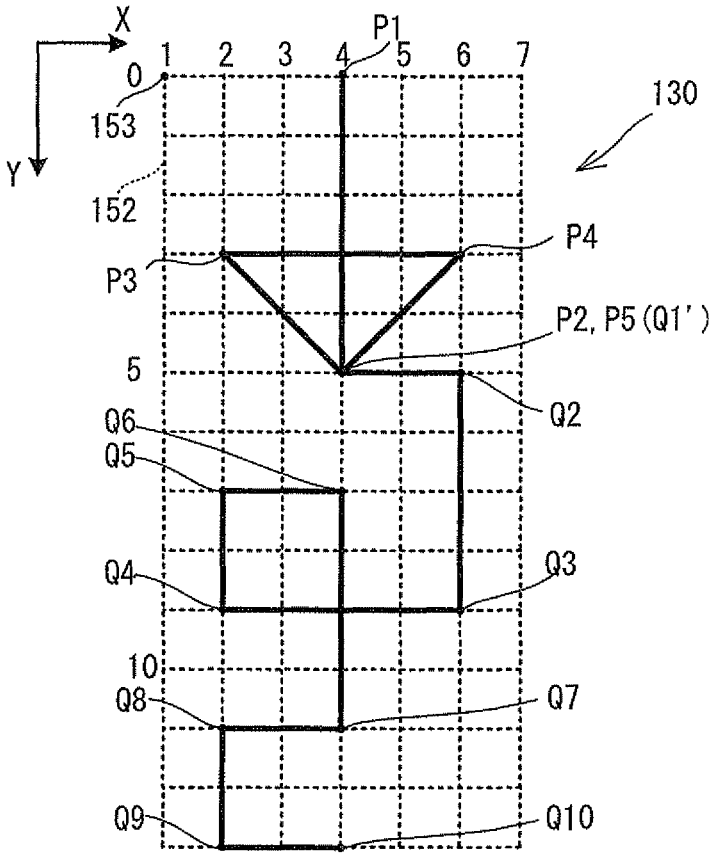
FIG. 19 is an explanatory diagram of a combined pattern.
Figure 21:
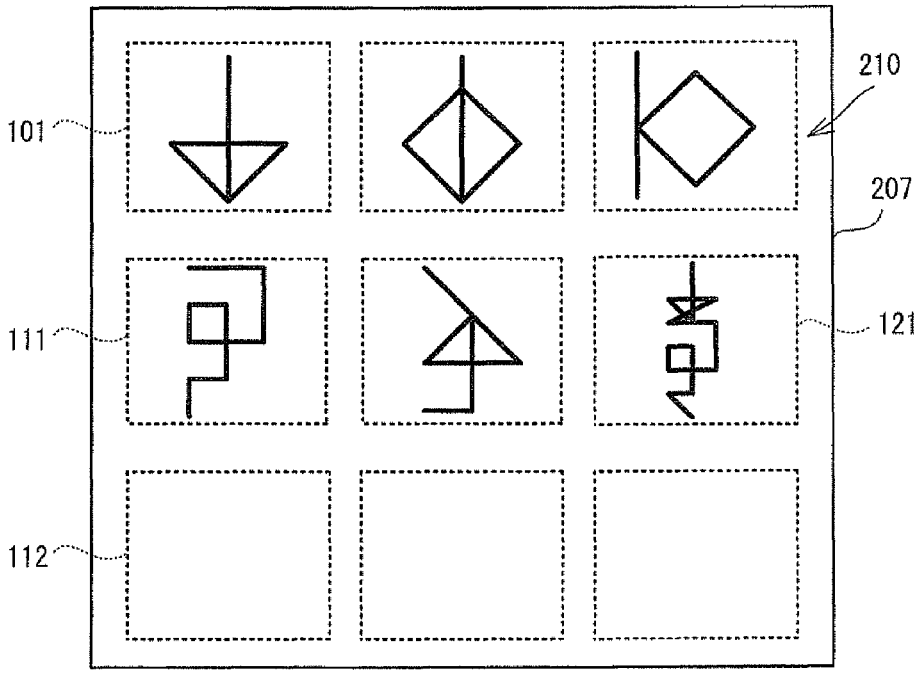
FIG. 21 is an explanatory diagram of a pattern call-up screen.
Figure 23:
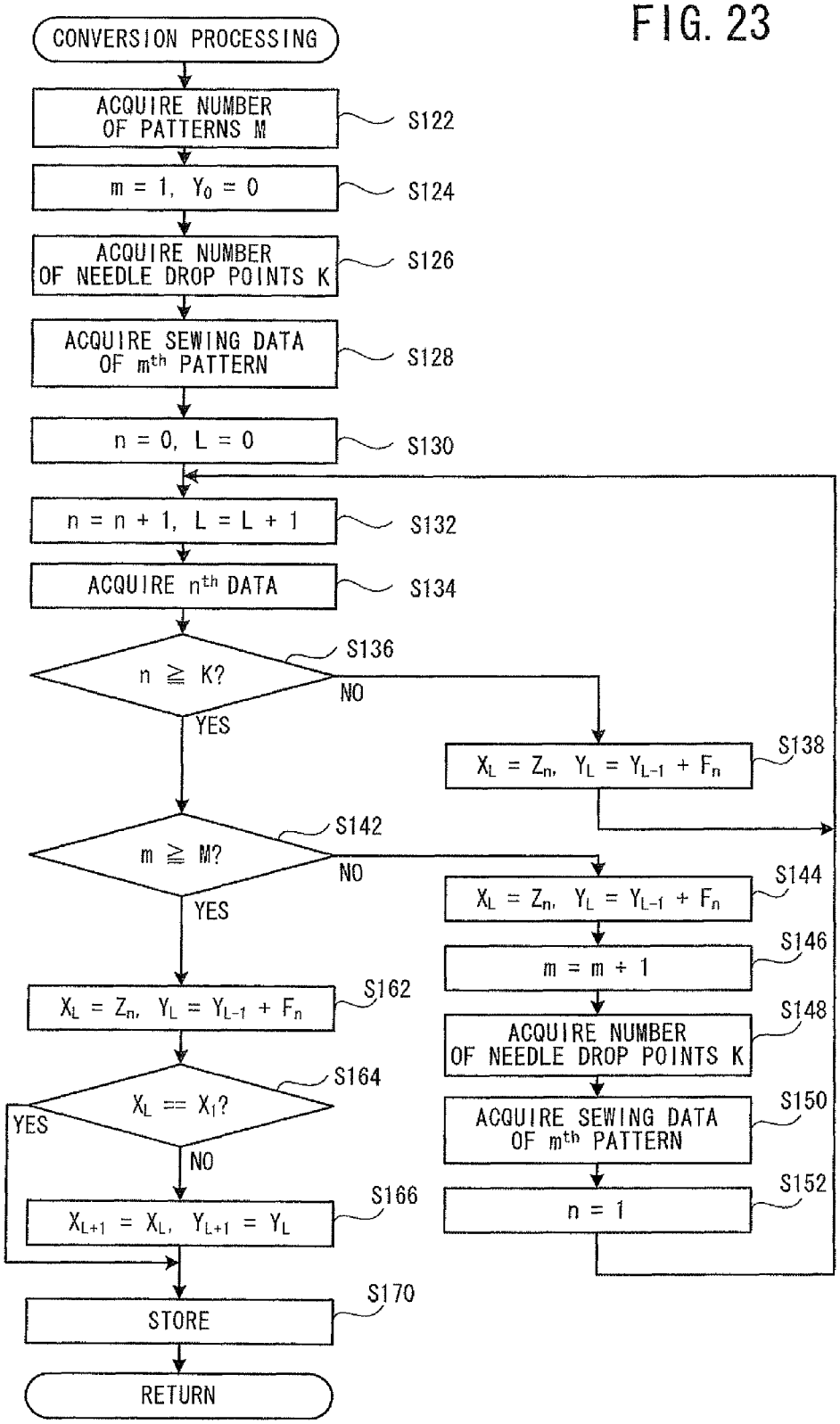
FIG. 23 is a flowchart of conversion processing according to a second embodiment.

With reference to FIG. 19, FIG. 20 and FIG. 23, the second sewing data generating processing that can be performed on the sewing machine 1 according to the second embodiment will be described. In the sewing machine 1 according to the second embodiment, the first sewing data generating processing and the sewing processing are performed that are substantially similar to the processing according to the first embodiment. The second sewing data generating processing according to the first embodiment and the second sewing data generating processing according to the second embodiment are different only with respect to the conversion processing that is performed at step S120 shown in FIG. 6, and the rest of the processing is substantially similar. Therefore, the conversion processing according to the second embodiment will be described below. With respect to the conversion processing according to the second embodiment, in a case where the conversion processing is performed in a specific example substantially similar to that of the first embodiment, the vector data 175 that represent the shape of the pattern 130 shown in FIG. 19 are generated by the conversion processing, based on the sewing data 170 shown in FIG. 5 and the sewing data 171 shown in FIG. 11.

In FIG. 23, the same step numbers are assigned to processing that performs substantially similar processing to that of the second sewing data generating processing according to the first embodiment, as shown in FIG. 15. The conversion processing according to the second embodiment is different from the conversion processing according to the first embodiment in that processing at step S144 is performed in the conversion processing according to the second embodiment, while the processing at step S154 and at step S156 are not performed in the conversion processing according to the second embodiment. Further, the conversion processing according to the second embodiment is different from the conversion processing according to the first embodiment in that, in the conversion processing according to the second embodiment, step S162 to step S166 are performed instead of step S160. Descriptions regarding processing that performs substantially similar processing to the conversion processing according to the first embodiment are omitted. The processing at step S144, step S162 to step S166 will be described below.

In the processing at step S144 in FIG. 23, $Z_n$ is set as $X_L$ and $(Y_{L-1}+F_n)$ is set as $Y_L$ in a substantially similar manner as in the processing at step S138. The set $X_L$ and $Y_L$ are stored in the RAM 63 (S144). Therefore, as shown in FIG. 20, the sewing machine 1 can change the needle drop point Q1 to a point Q1' and can match the point Q1' with the needle drop point P5.

In the processing at step S162, $Z_n$ is set as $X_L$ and $(Y_{L-1}+F_n)$ is set as $Y_L$ in the substantially similar manner as in the processing at step S138. The set $X_L$ and $Y_L$ are stored in the RAM 63. Next, it is determined whether the set $X_L$ and $X_1$ are equal (S164). In a case where $X_L$ is equal to $X_1$ (yes at step S164), vector data from $(X_1, Y_1)$ to $(X_L, Y_L)$ are stored in the EEPROM 64 (S170). In a case where $X_L$ is not equal to $X_1$ (no at step S164), $X_1$ is set as $X_{L+1}$ and $Y_L$ is set as $Y_{L+1}$. The set $X_{L+1}$ and $Y_{L+1}$ are stored in the RAM 63 (S166). In this way, a needle drop point Q10 (refer to FIG. 19 and FIG. 20) is added to the combined pattern. Therefore, the relative position of the needle drop point P1 with respect to the reference point 153 in the X axis direction (the needle drop point P1 is the first needle drop point in the sewing order of the combined pattern 120) is matched up with the relative position of the needle drop point Q10 with respect to the reference point 153 in the X axis direction (the needle drop point Q10 is the last needle drop point in the sewing order of the combined pattern 120). Next, vector data from $(X_1, Y_1)$ to $(X_{L+1}, Y_{L+1})$ are stored in the EEPROM 64 (S170).

The sewing machine 1 according to the second embodiment matches up the last needle drop point of the $N^{th}$ pattern in the combination order with the first needle drop point of the $(N+1)^{th}$ pattern in the combination order. Therefore, it is possible to prevent the shape of the $N^{th}$ pattern from being changed. In a case where the combined pattern is a repeated pattern, the sewing machine 1 can automatically match the relative positions of the start with the end points of the combined pattern in the left-right direction of the sewing machine 1 (the swing direction of needle bar 8 by the needle bar swing mechanism 59) without changing the shape of the last pattern in a repetition order.

The sewing machine disclosed herein is not limited to the above-described embodiments, and various modifications may be applied without departing from the spirit and scope of the present disclosure. For example, any one of the following modifications (A) to (C) may be applied as appropriate.

(A) In the above-described embodiments, the first sewing data generating processing and the second sewing data generating processing can be performed by the sewing machine 1. However, the first sewing data generating processing and the second sewing data generating processing may be performed by a data generating device including a general-purpose personal computer and a dedicated device. The structure of the sewing machine 1 may be changed as appropriate. For example, the feed direction of the sewing object by the feed dog 57 and the swing direction of the needle bar 8 by the needle bar swing mechanism 59 may be changed as appropriate. The sewing machine 1 may include an operational portion other than the touch panel 26 (a pointing device, for example) that can be used to make a command to select the pattern and to input the needle drop point.

(B) The first sewing data generating processing shown in FIG. 3 may be changed as appropriate, or omitted. For example, substantially similar pattern edit processing as that in the second sewing data generating processing shown in FIG. 6 may be performed in the first sewing data generating processing. In a case where the first sewing data generating processing is omitted, the second sewing data generating processing may be performed as processing of combining patterns that can be represented by the ready-made sewing data stored in the ROM 62 or the EEPROM 64.

(C) The second sewing data generating processing may be changed as appropriate. For example, any one of modifications from (C-1) to (C-4) described below may be applied.

(C-1) A method for setting the arrangement of the patterns at step S30 may be changed as appropriate. For example, the arrangement of the patterns may be set in accordance with an instruction of the user. Further, the user may be enabled to change the arrangement of patterns that is automatically set in accordance with predetermined rules.

(C-2) In a case where there is no need to respectively edit the relative positions of the needle drop points included in the plurality of patterns that have been selected, the processing from step S80 to step S100 may be omitted. In a case where there is no need to change the positions of the needle drop points included in the combined pattern, the processing from step S200 to step S220 may be omitted. A publicly known method may be used to appropriately perform the edit processing that can be performed at step S100 and step S210. The content of the edit processing may be changed as appropriate.

Figure 24:
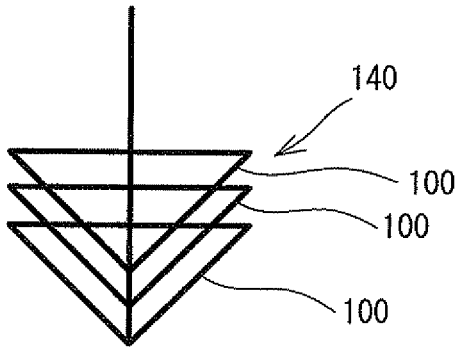
FIG. 24 is an explanatory diagram of a combined pattern.

(C-3) In the conversion processing shown in FIG. 15, the end point of the $N^{th}$ pattern in the combination order is matched with the start point of the $(N+1)^{th}$ pattern in the combination order. However, the above-described end point and start point need not match up. The needle drop points of the combined pattern may be set such that the end point of the $N^{th}$ pattern in the combination order and the start point of the $(N+1)^{th}$ pattern in the combination order are joined together by sewing a stitch of a predetermined feed amount. For example, as sewing data of a combined pattern 140 shown as an example in FIG. 24, in which a plurality of the patterns 100 are superimposed on one another, sewing data may be generated such that the sewing data include a back stitch of several seconds between the end point of the $N^{th}$ pattern in the combination order and the start point of the $(N+1)^{th}$ pattern in the combination order.

(C-4) In a case where the combined pattern is not a repeated pattern, the processing of matching the relative position (in the left-right direction with respect to the reference point) of the first needle drop point in the sewing order of the combined pattern with the relative position (in the left-right direction with respect to the reference point) of the last needle drop point in the sewing order of the combined pattern (matching-up processing) may be omitted. The sewing machine 1 may perform the matching-up processing in a case where a command is input to have the combined pattern created as a repeated pattern.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A data generating device comprising:

a selection portion that receives a selecting operation of a user corresponding to a selection of a plurality of patterns from among patterns that are to be sewn based on sewing data stored in a storage portion, the sewing data being data that indicates an amount of movement of a sewing object fed by a feed dog in a first predetermined direction and a swing position of a needle bar swung by a needle bar swing mechanism in a second predetermined direction, the feed dog, the needle bar swing mechanism and the needle bar being provided in a sewing machine, and the second predetermined direction being a direction that intersects with the first predetermined direction;

an acquisition portion that acquires a plurality of first sewing data from the storage portion, the plurality of first sewing data being a plurality of sewing data, each of which corresponds to each of the selected plurality of patterns included in the selection;

an arrangement setting portion that sets an arrangement of the selected plurality of patterns;

a first sewing data generating portion that generates second sewing data based on the first sewing data that are acquired by the acquisition portion, the second sewing data being sewing data for sewing a combined pattern that is a pattern that combined the plurality of patterns selected by the selection portion in accordance with the arrangement set by the arrangement setting portion; and a first storage control portion that causes the second sewing data generated by the first sewing data generating portion to be stored in the storage portion such that it can be acquired by the acquisition portion, wherein the first sewing data generating portion includes:

a vector data generating portion that generates vector data based on the first sewing data acquired by the acquisition portion and on the arrangement set by the arrangement setting portion, the vector data being data that are represented by relative positions with respect to a reference point of needle drop points of the combined pattern; and a second sewing data generating portion that generates the second sewing data based on the vector data generated by the vector data generating portion.

2. The data generating device according to claim 1, further comprising:

an edit portion that edits the vector data by changing the relative positions, wherein the second sewing data generating portion generates the second sewing data in which the relative positions have been changed based on the vector data edited by the edit portion.

3. The data generating device according to claim 1, wherein the vector data generating portion generates the vector data by matching, of the plurality of patterns included in the combined pattern, a last needle drop point of a $N^{th}$ pattern in a combination order with a first needle drop point of a $N+1^{th}$ pattern in the combination order, the combination order being determined based on the arrangement set by the arrangement setting portion, and N being a natural number.

4. The data generating device according to claim 1 wherein the vector data generating portion generates the vector data by matching a relative position of a first needle drop point of the combined pattern with respect to the reference point in the second predetermined direction with a relative position of a last needle drop point of the combined pattern with respect to the reference point in the second predetermined direction.

5. The data generating device according to claim 1, further comprising:

an input portion that inputs relative positions of needle drop points with respect to a reference point;

a third sewing data generating portion that generates the sewing data based on the relative positions that are input by the input portion; and a second storage control portion that causes the sewing data generated by the second sewing data generating portion to be stored in the storage portion such that it can be acquired by the acquisition portion.

6. A sewing machine comprising:

a needle bar that has a sewing needle fitted at a bottom end;

a feed mechanism that drives a feed dog that moves a sewing object in a first predetermined direction;

a needle bar swing mechanism that swings the needle bar in a second predetermined direction, the second predetermined direction being a direction that intersects with the first predetermined direction;

a selection portion that receives a selecting operation of a user corresponding to a selection of a plurality of patterns from among patterns that are to be sewn based on sewing data stored in a storage portion, the sewing data being data that indicates an amount of movement of the sewing object fed by the feed dog in the first predetermined direction and a swing position of the needle bar swung by the needle bar swing mechanism in the second predetermined direction;

an acquisition portion that acquires a plurality of first sewing data from the storage portion, the plurality of first sewing data being a plurality of sewing data, each of which corresponds to each of the selected plurality of patterns included in the selection;

an arrangement setting portion that sets an arrangement of the selected plurality of patterns;

a first sewing data generating portion that generates second sewing data based on the first sewing data that are acquired by the acquisition portion, the second sewing data being sewing data for sewing a combined pattern that is a pattern that combined the plurality of patterns selected by the selection portion in accordance with the arrangement set by the arrangement setting portion;

a first storage control portion that causes the second sewing data generated by the first sewing data generating portion to be stored in the storage portion such that it can be acquired by the acquisition portion; and a sewing portion that sews the combined pattern on the sewing object based on the second sewing data by controlling the feed mechanism and the needle bar swing mechanism, wherein the first sewing data generating portion includes:

a vector data generating portion that generates vector data based on the first sewing data acquired by the acquisition portion and on the arrangement set by the arrangement setting portion, the vector data being data that are represented by relative positions with respect to a reference point of needle drop points of the combined pattern; and a second sewing data generating portion that generates the second sewing data based on the vector data generated by the vector data generating portion.

7. The sewing machine according to claim 6, further comprising:

an edit portion that edits the vector data, wherein the second sewing data generating portion generates the second sewing data in which the relative positions have been changed based on the vector data edited by the edit portion.

8. The sewing machine according to claim 6,wherein the vector data generating portion generates the vector data by matching, of the plurality of patterns included in the combined pattern, a last needle drop point of a $N^{th}$ pattern in a combination order with a first needle drop point of a $N+1^{th}$ pattern in the combination order, the combination order being determined based on the arrangement set by the arrangement setting portion, and N being a natural number.

9. The sewing machine according to claim 6, wherein the vector data generating portion generates the vector data by matching a relative position of a first needle drop point of the combined pattern with respect to the reference point in the second predetermined direction with a relative position of a last needle drop point of the combined pattern with respect to the reference point in the second predetermined direction.

10. The sewing machine according to claim 7, further comprising:

an input portion that inputs relative positions of needle drop points with respect to a reference point;

a third sewing data generating portion that generates the sewing data based on the relative positions that are input by the input portion; and a second storage control portion that causes the sewing data generated by the second sewing data generating portion to be stored in the storage portion such that it can be acquired by the acquisition portion.

11. A non-transitory computer-readable medium storing a control program executable on a data generating device, the program comprising instructions that cause a computer of the data generating device to perform the steps of:

accepting, from among patterns that are to be sewn based on sewing data stored in a storage portion, a selection of a plurality of patterns, the sewing data being data that indicates an amount of movement of a sewing object fed by a feed dog in a first predetermined direction and a swing position of a needle bar swung by a needle bar swing mechanism in a second predetermined direction, the feed dog, the needle bar swing mechanism and the needle bar being provided in a sewing machine, and the second predetermined direction being a direction that intersects with the first predetermined direction;

acquiring a plurality of first sewing data from the storage portion, the plurality of first sewing data being a plurality of sewing data, each of which corresponds to each of the selected plurality of patterns included in the selection;

setting an arrangement of the selected plurality of patterns;

generating second sewing data based on the acquired first sewing data, the second sewing data being sewing data for sewing a combined pattern that is a pattern that combined the selected plurality of patterns in accordance with the set arrangement; and causing the generated second sewing data to be stored in the storage portion such that it can be acquired, wherein the step of generating the second sewing data includes the steps of:

generating vector data based on the acquired first sewing data and the set arrangement, the vector data being data that are represeneted by relative positions with respect to a reference point of needle drop points of the combined pattern; and generating the second sewing data based on the generated vector data.

12. The non-transitory computer-readable medium according to claim 11, wherein the program further comprises instructions that cause the computer to perform the steps of:

editing the generated vector data by changing the relative positions; and generating the second sewing data in which the relative positions have been changed based on the edited vector data.

13. The non-transitory computer-readable medium according to claim 11, wherein the step of generating the vector data generates the vector data by matching a last needle drop point of a Nth pattern of the plurality of patterns included in the combined pattern in a combination order with a first needle drop point of a N+1th pattern of the plurality of patterns included in the combined pattern in the combination order, the combination order being determined based on the set arrangement, and N being a natural number.

14. The non-transitory computer-readable medium according to claim 11, wherein the step of generating the vector data generates the vector data by matching a relative position of a first needle drop point of the combined pattern with respect to the reference point in the second predetermined direction with a relative position of a last needle drop point of the combined pattern with respect to the reference point in the second predetermined direction.

15. The non-transitory computer-readable medium according to claim 11, wherein the program further comprises instructions that cause the computer to perform the steps of:

accepting a designation of relative positions of needle drop points with respect to a reference point;

generating the sewing data based on the designated relative positions; and causing the generated sewing data to be stored in the storage portion such that it can be acquired.

* * * * *